US010672306B1

(12) United States Patent
Whidden

(10) Patent No.: US 10,672,306 B1
(45) Date of Patent: Jun. 2, 2020

(54) MODULAR DISPLAY ASSEMBLY AND RELATED COMPONENTS AND METHODS OF USE

(71) Applicant: Totally Mod Events, LLC, Orlando, FL (US)

(72) Inventor: William L. Whidden, Orlando, FL (US)

(73) Assignee: TOTALLY MOD EVENTS, LLC, Orlando, FL (US)

( * ) Notice: Subject to any disclaimer, the term of this patent is extended or adjusted under 35 U.S.C. 154(b) by 0 days.

(21) Appl. No.: 15/462,170

(22) Filed: Mar. 17, 2017

Related U.S. Application Data

(60) Provisional application No. 62/310,000, filed on Mar. 18, 2016.

(51) Int. Cl.
*G09F 15/00* (2006.01)

(52) U.S. Cl.
CPC ..... *G09F 15/0068* (2013.01); *G09F 15/0062* (2013.01)

(58) Field of Classification Search
CPC ..... G09F 15/0068; G09F 15/0062; G09F 15/0075; G09F 15/0087; G09F 15/0012; G09F 15/0056; G09F 9/3025; E04B 2/7437; E04B 2/7405; G06F 3/1466; A47F 5/105; F16B 2001/0035
USPC ..... 52/311.3
See application file for complete search history.

(56) References Cited

U.S. PATENT DOCUMENTS

| | | | | | |
|---|---|---|---|---|---|
| 276,100 | A * | 4/1883 | Vedder | E04B 5/46 | 404/22 |
| 1,056,810 | A * | 3/1913 | McDonald | E06B 9/01 | 52/238.1 |
| 2,241,338 | A * | 5/1941 | Balduf | E04B 2/842 | 52/241 |
| 2,970,396 | A * | 2/1961 | Worrell | A47F 5/105 | 160/135 |
| D195,950 | S * | 8/1963 | Kopp | 52/311.3 | |
| D197,124 | S * | 12/1963 | Stoy | 52/311.3 | |
| 3,593,474 | A * | 7/1971 | Neels | B44C 3/12 | 52/223.7 |
| 4,001,987 | A * | 1/1977 | Coulthard | E04B 2/7442 | 160/135 |

(Continued)

*Primary Examiner* — Kyle J. Walraed-Sullivan
(74) *Attorney, Agent, or Firm* — Allen Dyer Doppelt & Gilchrist, PA

(57) ABSTRACT

A modular display assembly includes a plurality of display tiles, a plurality of connecting plates connecting the plurality of display tiles and a support structure supporting the plurality of display tiles and the plurality of connecting plates. Each of the display tiles having magnets and mounting holes adjacent thereto in locations along a periphery thereof. Each of the connecting plates has a base and at least one post. Adjacent tiles are commonly connected to plates having at least two posts, the base of the connecting plate being magnetically connected to respective magnets of the adjacent tiles with the two posts extending into respective adjacent mounting holes. Some of the connecting plates engage the support structure, a first row of display tiles is connected thereto, additional connecting plates are connected to the first row of display tiles and a second row of display tiles is connected to the additional connecting plates.

17 Claims, 7 Drawing Sheets

(56) References Cited

U.S. PATENT DOCUMENTS 4,436,135 A * 3/1984 Ytter ..... G09F 15/0068 160/135
4,493,425 A * 1/1985 Yoshida ..... A47B 47/0033 206/504
4,497,125 A * 2/1985 Hutchinson ..... G09F 1/10 211/40
4,561,232 A * 12/1985 Gladden, Jr. ..... E04F 15/02423 52/126.6
4,673,152 A * 6/1987 Brown ..... A47G 1/215 211/40
4,736,555 A * 4/1988 Nagare ..... E04F 15/02452 248/544
4,785,565 A * 11/1988 Kuffner ..... A47F 5/105 160/135
4,865,111 A * 9/1989 Perutz ..... A47F 5/105 160/135
4,942,686 A * 7/1990 Kemeny ..... G09F 15/0068 40/610
5,172,504 A * 12/1992 De Maat ..... G09F 7/18 40/605
5,220,952 A * 6/1993 Beaulieu ..... A47G 1/065 160/135
5,263,289 A * 11/1993 Boyd ..... H02G 3/285 52/220.2
5,494,178 A * 2/1996 Maharg ..... A47F 5/0815 211/182
5,515,900 A * 5/1996 West ..... A47G 5/00 160/135
5,694,881 A * 12/1997 Creech ..... G09F 15/0056 116/222
5,993,287 A * 11/1999 Melashenko ..... E04H 15/008 160/135
6,065,258 A * 5/2000 McClatchy ..... B44C 7/022 40/606.03
6,105,319 A * 8/2000 Brunt ..... E06B 3/5436 52/204.593
6,138,434 A * 10/2000 Demars ..... A47F 3/0434 52/786.13
6,158,178 A * 12/2000 Jeffers ..... E04B 2/7437 52/220.7
6,161,320 A * 12/2000 Peterson ..... G09F 15/0025 160/135
6,253,517 B1 * 7/2001 Fancher ..... E04B 1/6187 52/127.11
6,430,894 B1 * 8/2002 Chae ..... E04B 2/885 52/204.593
6,702,640 B1 * 3/2004 Park ..... A63H 33/04 446/105
6,718,709 B2 * 4/2004 Koutras ..... E04B 2/7405 160/135
6,729,054 B1 * 5/2004 VanderTuin ..... G09F 9/30 16/236
6,761,003 B2 * 7/2004 Lind ..... E06B 3/5436 403/293
6,971,197 B1 * 12/2005 Seiber ..... G09F 7/18 40/530
7,650,726 B2 * 1/2010 Jakob-Bamberg ..... E04B 5/48 248/188.2
7,818,930 B2 * 10/2010 Le Bot ..... E04F 11/1853 52/235
7,980,527 B2 * 7/2011 Gronvall ..... B02C 17/22 241/182
8,091,305 B2 * 1/2012 Skeeter ..... E01F 8/025 52/311.1
8,124,210 B2 * 2/2012 Kim ..... E04F 13/0885 428/49
9,222,759 B2 * 12/2015 White ..... F41H 5/08
9,477,438 B1 * 10/2016 Hochman ..... G09G 5/02
9,717,353 B1 * 8/2017 Borra ..... A47G 1/17
9,845,816 B2 * 12/2017 Brashnyk ..... G09F 9/33
10,060,462 B2 * 8/2018 Nilsson ..... A47B 47/042
2002/0197586 A1 * 12/2002 Worth ..... G09B 25/00 434/75
2003/0056413 A1 * 3/2003 Wiemer ..... G09F 7/00 40/730
2003/0192271 A1 * 10/2003 Koutras ..... E04B 2/7405 52/285.1
2005/0200951 A1 * 9/2005 Redmon ..... G09F 1/12 359/443
2006/0048421 A1 * 3/2006 Oleksak ..... G09F 15/0068 40/610
2006/0168855 A1 * 8/2006 D'Urban Jackson ... A47F 5/105 40/584
2006/0213139 A1 * 9/2006 Stramandinoli ..... E04B 2/885 52/384
2007/0107853 A1 * 5/2007 Hsieh ..... E04B 2/7427 160/135
2008/0037284 A1 * 2/2008 Rudisill ..... F21S 2/005 362/629
2009/0313919 A1 * 12/2009 Chuang ..... A47F 5/0846 52/202
2010/0159160 A1 * 6/2010 Basile ..... G09F 15/0006 428/14
2011/0088298 A1 * 4/2011 Pemberton ..... G09F 7/04 40/541
2011/0197519 A1 * 8/2011 Henriott ..... A47B 46/005 52/36.1
2011/0263177 A1 * 10/2011 Lemchen ..... A63H 33/04 446/87
2012/0236509 A1 * 9/2012 Cope ..... G02F 1/133305 361/730
2012/0241401 A1 * 9/2012 Galey ..... A47F 5/0815 211/189
2013/0149029 A1 * 6/2013 Changsrivong ..... F16B 17/00 403/361
2013/0167458 A1 * 7/2013 Cerny ..... E04F 15/02038 52/177
2014/0003052 A1 * 1/2014 Hemiller ..... F21V 21/34 362/249.02
2014/0125232 A1 * 5/2014 Griffiths ..... F21V 21/096 315/154
2014/0197124 A1 * 7/2014 McPhillips ..... G09F 15/0068 211/195
2014/0283459 A1 * 9/2014 Maxam ..... A63J 1/02 52/7
2014/0352746 A1 * 12/2014 Connors ..... E04H 1/1272 135/121
2015/0016034 A1 * 1/2015 Kludt ..... F16B 2/12 361/679.01
2016/0160507 A1 * 6/2016 Pantev ..... F16B 5/0084 52/582.2
2016/0210886 A1 * 7/2016 Brashnyk ..... G09F 9/3026
2016/0348854 A1 * 12/2016 Wu ..... G09F 13/00
2017/0006727 A1 * 1/2017 Ryu ..... H01L 25/0753
2017/0052754 A1 * 2/2017 Patterson ..... G06F 3/1446
2017/0065902 A1 * 3/2017 Maxam ..... A63J 1/02
2017/0127539 A1 * 5/2017 Drabant ..... H05K 5/0021
2017/0128868 A1 * 5/2017 Simmons ..... B01D 46/0005
2017/0234006 A1 * 8/2017 Maxam ..... A63J 1/02 52/850
2017/0303407 A1 * 10/2017 Lee ..... H05K 5/0021
2018/0073252 A1 * 3/2018 Janko ..... A47G 1/17
2018/0213657 A1 * 7/2018 Drabant ..... F21V 19/00

* cited by examiner

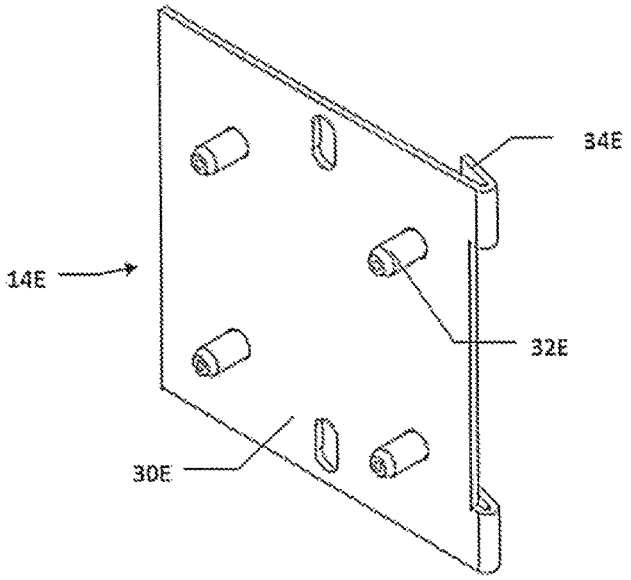
Fig. 10
Fig. 11
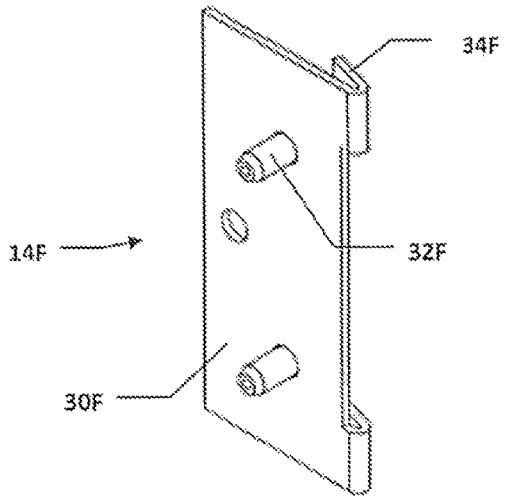
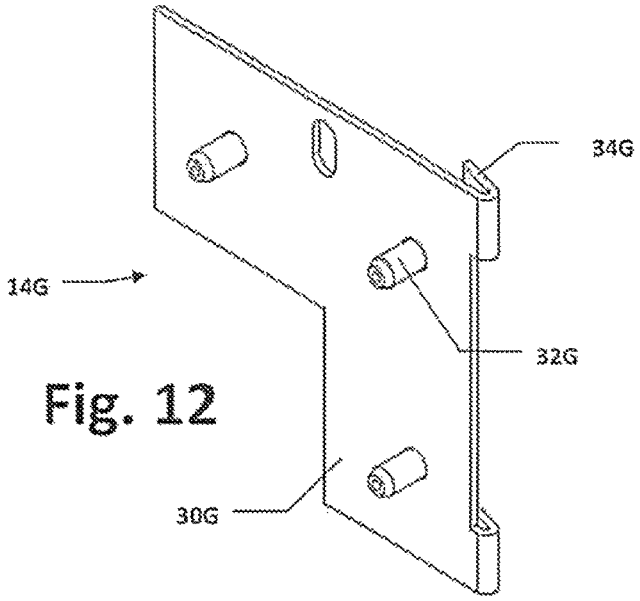
Fig. 12

MODULAR DISPLAY ASSEMBLY AND RELATED COMPONENTS AND METHODS OF USE

CROSS-REFERENCE TO RELATED APPLICATION

This application claims the benefit of U.S. Provisional Application Ser. No. 62/310,000, filed on Mar. 18, 2016, the contents of which are herein incorporated by reference in their entirety.

FIELD OF THE INVENTION

The present invention relates to modular displays, and more particularly, to modular displays formed as an assembly of interconnected panels.

BACKGROUND OF THE INVENTION

Modular display walls that can be readily assembled and disassembled are used on a variety of occasions. For example, an exhibitor at a convention may want an impressive backdrop or entrance for a booth, or a merchandiser may want to call extra attention to a collection of seasonal items. Some systems exist for creating modular displays of this type, which give a degree of design flexibility by using a plurality of panels that can be interconnected with different types of hardware to form display walls. Despite the benefits offered by such systems, further improvements are possible.

SUMMARY OF THE INVENTION

In view of the foregoing, it is an object of the present invention to provide an improved modular display assembly, along with related components and methods of use. According to an embodiment of the present invention, a modular display assembly includes a plurality of display tiles, a plurality of connecting plates connecting the plurality of display tiles and a support structure supporting the plurality of display tiles and the plurality of connecting plates. Each of the display tiles having magnets and mounting holes adjacent thereto in locations along a periphery thereof. Each of the connecting plates has a base and at least one post. At least two adjacent tiles are commonly connected to at least one of the connecting plates having at least two posts, the base of the connecting plate being magnetically connected to respective magnets of the adjacent tiles with the two posts extending into respective adjacent mounting holes.

According to a method aspect, a portion of the connecting plates are engaged with the support structure, a first row of display tiles is connected thereto, additional connecting plates are connected to the first row of display tiles and a second row of display tiles are connected to the additional connecting plates.

These and other objects, aspects and advantages of the present invention will be better appreciated in view of the drawings and following detailed description of preferred embodiments.

BRIEF DESCRIPTION OF THE DRAWINGS

FIGS. 7-18 are perspective views of alternate embodiments of the connecting plate of FIG. 5.

DETAILED DESCRIPTION OF PREFERRED EMBODIMENTS

Figure 1:
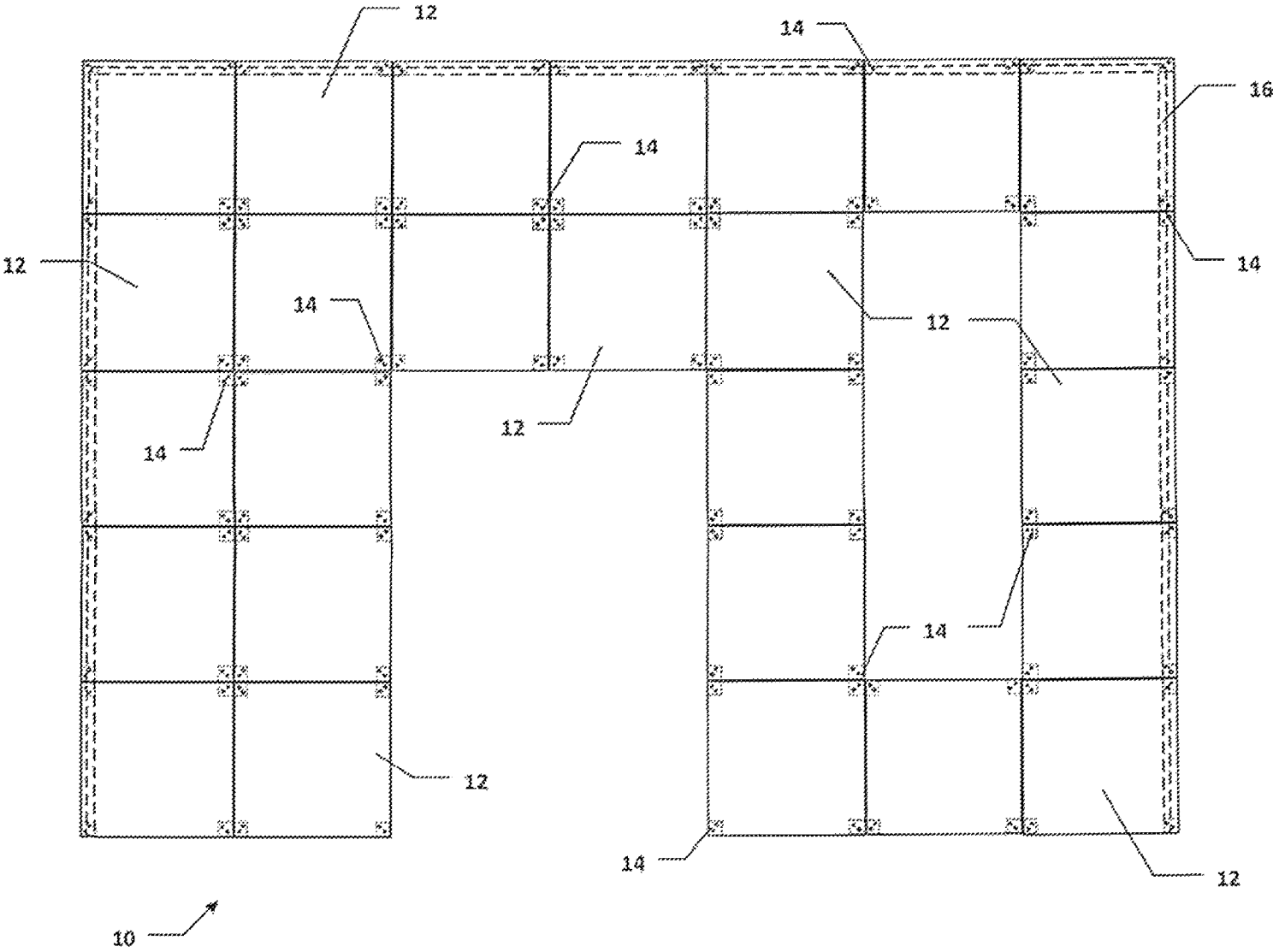
FIG. 1 is a front view of a modular display assembly, including a plurality of display tiles and connecting plates, according to an embodiment of the present invention, with hidden components shown in broken lines.

Referring to FIG. 1, according to an embodiment of the present invention, a modular display assembly 10 includes a plurality of display tiles 12 and connecting plates 14 suspended from a frame 16 or other support structure. The tiles 12 and connecting plates 14 can be quickly assembled into a variety of configurations. Once assembled, the resultant configuration of tiles 12 and plates 14 is highly resistant to inadvertent disassembly, while allowing ready replacement of individual tiles 12 and plates 14 therein without complete disassembly being required. Additionally, once disassembly is desired, disconnection of the tiles 12 and plates 14 is relatively quick and easy. In FIG. 1, the plates 14 and frame 16 are shown in broken lines, as these components would normally be hidden by the tiles 12 when the assembly 10 was viewed from the front.

Figure 2:
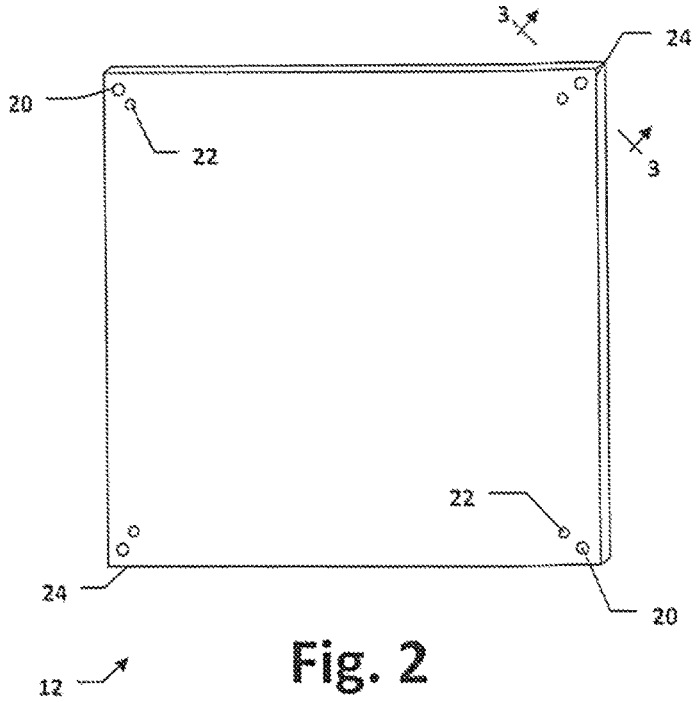
FIG. 2 is a perspective view of an exemplary one of the display tiles of Figure.

Referring to FIG. 2, each tile 12 includes magnets 20 and adjacent mounting holes 22 in the corners 24 thereof, and/or at other locations along a periphery of the tile 12. In the depicted embodiment, each magnet 20 is located closer to the apex of its respective corner 24 than the respective mounting 22, which is believed to represent a preferred embodiment, but a different relative relationship could be used. More significantly, whatever relative relationship is selected between the apex of the corner 24, the magnet 20 and the mounting hole 22, that same relationship is preferably repeated in each corner 24—as in the depicted embodiment—for flexible compatibility with the plates 12.

Figure 3:
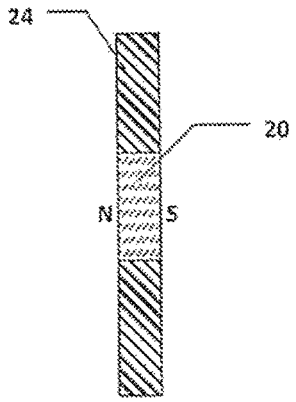
FIG. 3 is a sectional view taken along line 3-3 of FIG. 2.

Relatively strong permanent magnets are preferred for the magnets 20, with neodymium magnets believed to represent a most preferred embodiment, although other magnet types could be used. Advantageously, the magnets 20 and tile 12 are dimensioned such that front and back surfaces of each magnet 20 are flush with the corresponding surfaces of the tile 12 (see FIG. 3). The front and/or back surfaces of each magnet 20 can be painted, covered with a sticker, or the like so as to color coordinate with the tile 10. Preferably, each magnet 20 is installed in the tile 12 with the same polarity (e.g., such that the "north" pole of each magnet is facing the same surface of the tile 12). This permits easy alignment and stacking of the tiles 12 for storage and transport before and after use in a given location.

Figure 4:
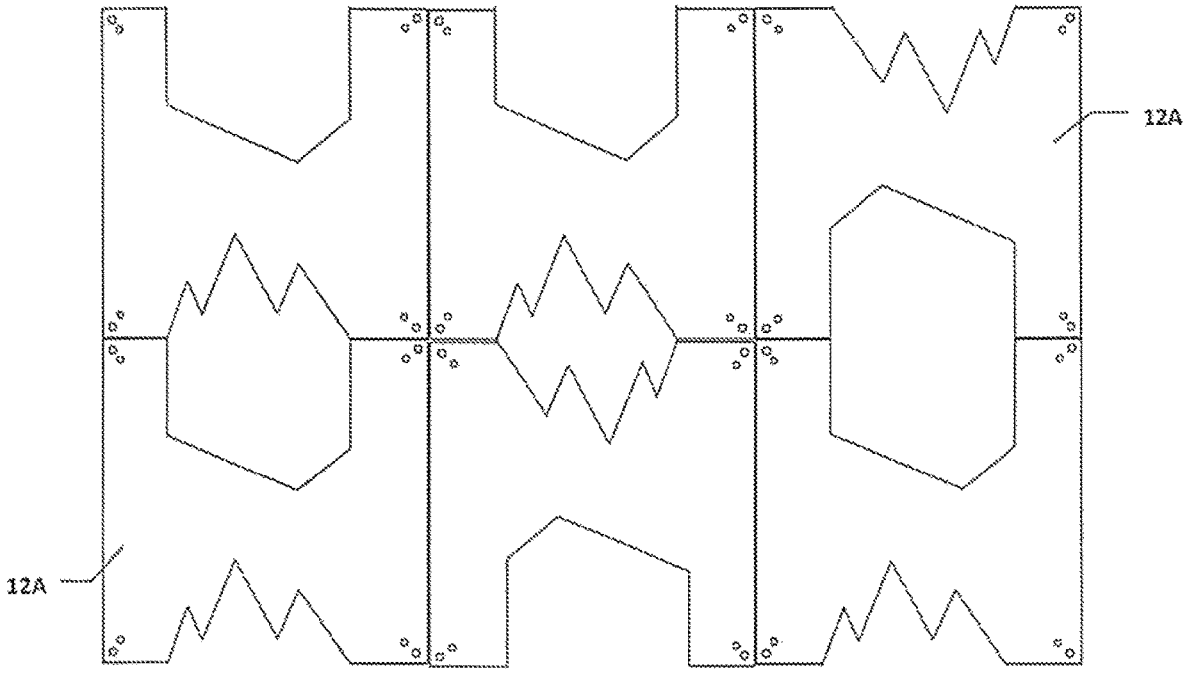
FIG. 4 is a front view of a plurality of display tiles, which are alternate embodiments of the display tile of FIG. 2.

Square tiles 12 give a large amount of design flexibility, although other tile shapes could be utilized in connection with the present invention. For example, rectangular tiles half the size of the square tiles 12 could be advantageously incorporated. Systems could also be implemented using triangular tiles, pentagonal tiles, hexagonal tiles, tiles with one or more curved or irregular edges, etc. that connected in the same manner via appropriately configured plates 14. Additionally, the tiles 12 can be colored or decorated in any desired manner, and can also be made of or incorporate transparent or translucent materials. Advantageously, unit designs can be formed on the tiles 12A (see FIG. 4) which align with designs on adjacent tiles 12A once assembled. Unit designs can be configured such that different orientations of a given tile 12A will align with an adjacent tile 12A to create a different, but still aligned, overall appearance. (Letters are used herein to distinguish between different embodiments of assembly 10 components, with similar reference numerals being given to similar components.)

Figure 5:
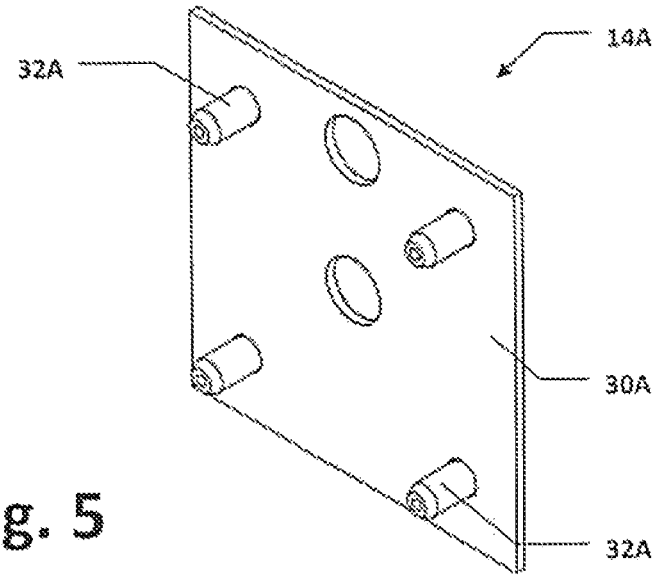
FIG. 5 is a perspective view of an exemplary one of the connecting plates of FIG. 1.

A plurality of different connecting plates 14 can be employed, with particular configurations being dependent on where a plate 14 is to be used in a display assembly 10. Referring to FIG. 5, a plate 14A includes a base 30A with one or more posts 32A extending outwardly therefrom. In general, the base 30A is made of a magnetic or magnetizable (e.g., ferromagnetic) metal to which the magnets 20 will magnetically adhere. Alternately, discrete magnetic or magnetizable areas could be attached to, otherwise incorporated into, a non-magnetic base.

The posts 32A are all preferably of approximately the same radius, which is dimensioned to be closely accommodated in the mounting holes 22 of the tiles 12. The posts 32A could be either threaded, to receive a nut or the like on the opposite side of a tile 12, or unthreaded. For the majority of tile 12 uses, a smooth post 32A is preferred, as the attraction between the magnets 20 and the base 30A will be sufficient to ensure the posts 32A remain in the holes 22. This is particularly the case for tiles 12 hanging vertically, as gravity does not act to pull such tiles 12 off their posts 32A, such that the respective magnets 20 are not directly working against gravity.

Preferably, the height or each post 32A is greater than the thickness of the tiles 12, and most preferably approximately twice the thickness. This allows more than one tile 12 to be placed on a post, enabling the creation of a layered design. For example, a more complex pattern could be achieved by attaching one tile design in front of another. In another example, a solid, colored, translucent tile could be placed behind a cut-out patterned tile.

Figure 6:
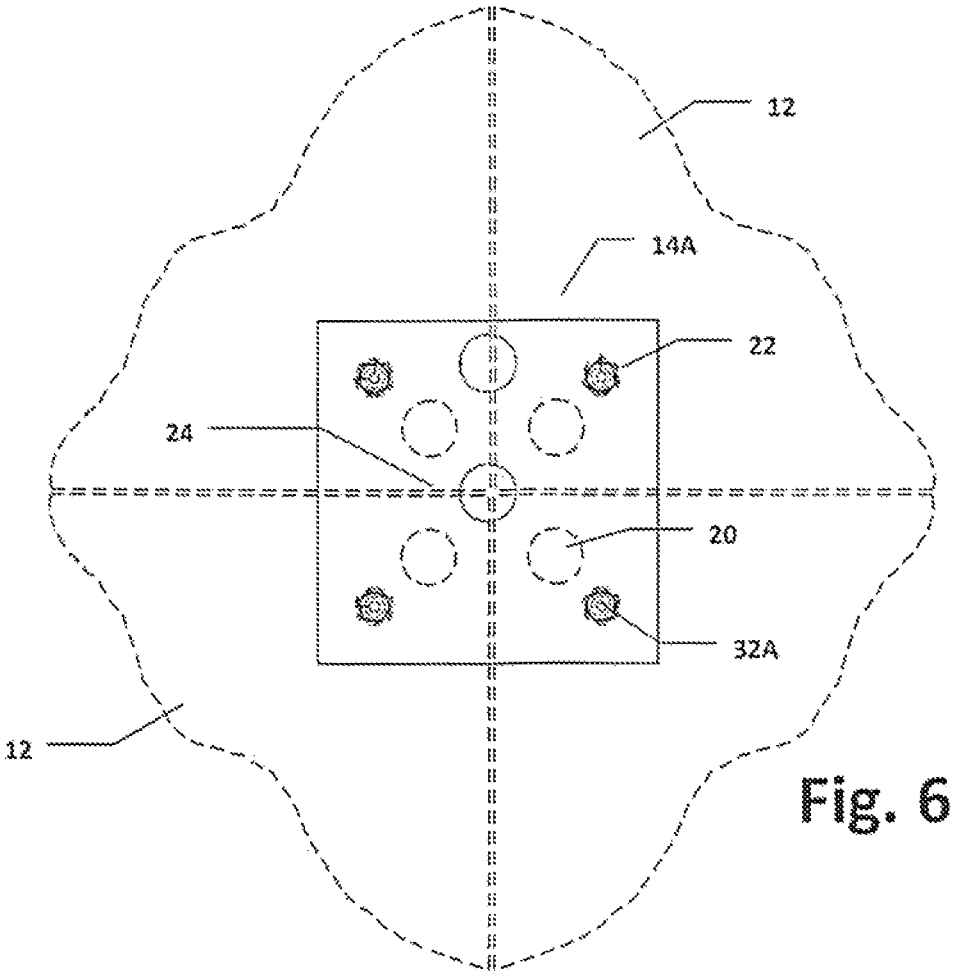
FIG. 6 is a front view of the connecting plate of FIG. 5, connected to a plurality of the display tiles of FIG. 2.

The plate 14A shown in FIG. 5 is configured to connect corners 24 of four adjacent tiles 12. It will be appreciated that the spacing of the posts 32A on the plates 14 and the mounting holes 22 on the tiles 12 determine the appearance of the abutting corners. In a preferred embodiment, the corners 24 abut (see FIG. 6), such that the plate 14 is not visible therebehind, but other configurations are possible within the scope of the present invention. Additionally, the posts 32 could be painted or otherwise colored to coordinate with the tiles 12 and minimize or enhance the visibility thereof.

Figure 7:
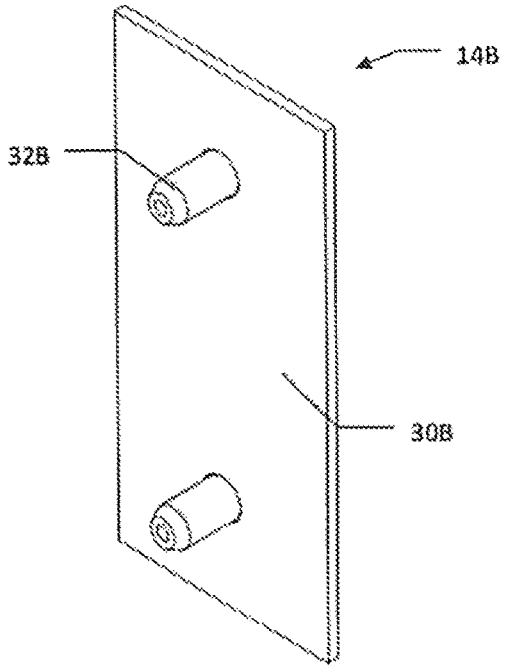
Figure 8:
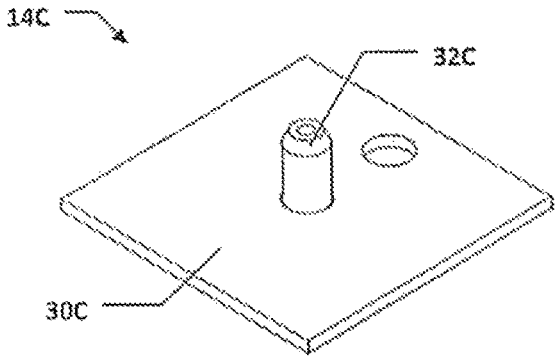
Figure 9:
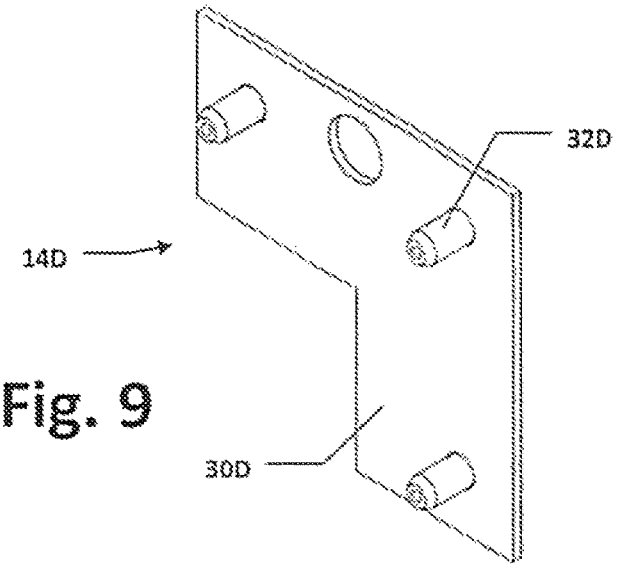

Referring to FIG. 7, a plate 14B is configured to connect corners 24 of two adjacent tiles 12. A plate 148 could be used, for example, alongside or bottom edges of a tile assembly. Referring to FIG. 8, a plate 14C is configured to attach to a corner of a single tile 12. While not connecting adjacent tiles, the plate 14C could be used, for instance, at exterior corners for weight and/or uniformity of appearance. Referring to FIG. 9, a plate 14D is configured to attach to corners of three adjacent tiles 12. The plate 14D could be used, by way of example, at a corner of opening formed within a tile assembly.

Figure 13:
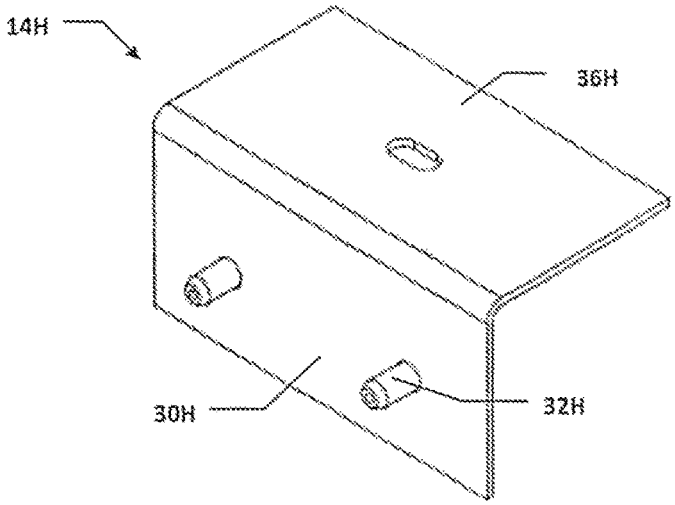
Figure 14:
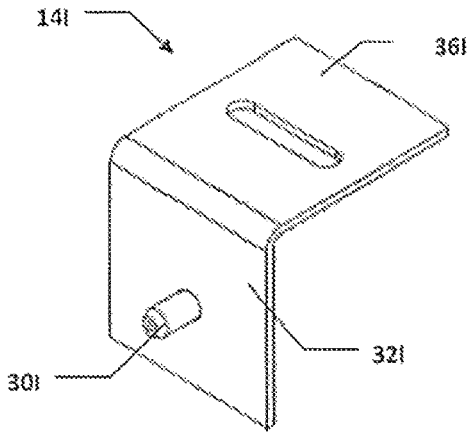
Figure 15:
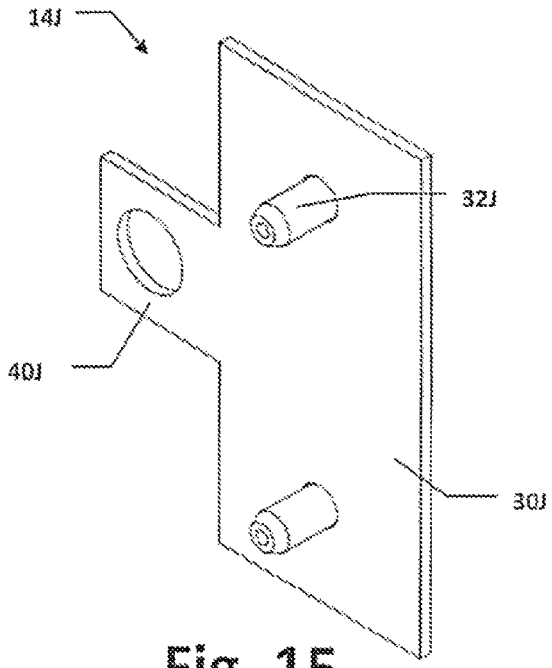
Figure 16:
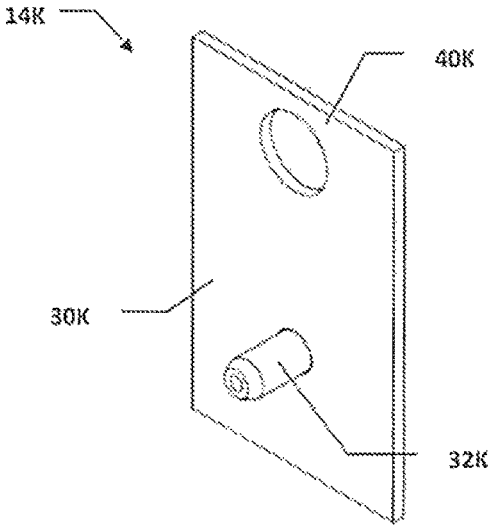

It can be advantageous to have a protruding surface on the opposite side of a plate 14, allowing engagement of the plate 14 with framework, wires, or other structural components behind or adjacent to a portion of the tiles 12. Referring to FIGS. 10-12, plates 14E, 14F and 14G are configured the same as plates 14A, 14B and 14D, but also incorporate respective bent portions 34E, 34F, and 34G. In a given tile assembly, tiles 12 lower in the assembly are suspended from tiles above. Plates 14H and 141 (see FIGS. 13 and 14) incorporate respective perpendicular hanging surfaces 36H and 361 for hanging tiles 12 in a top row from the frame 16 or other structure. Alternately, plates 14J and 14K (see FIGS. 15 and 16) incorporate respective hanging tabs 40J and 40K.

Figure 17:
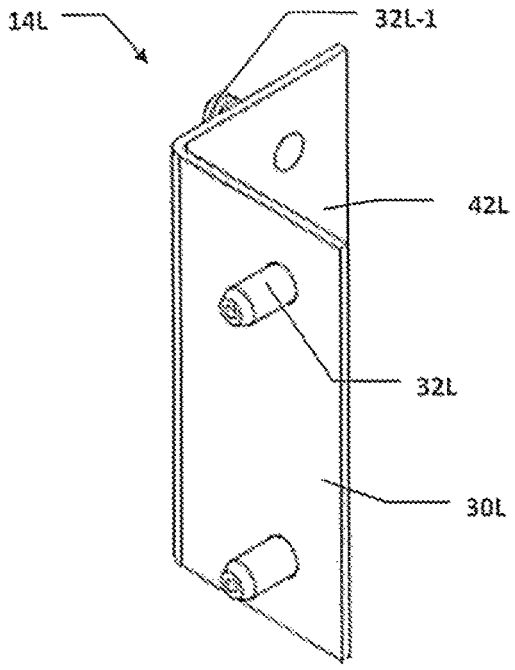
Figure 18:
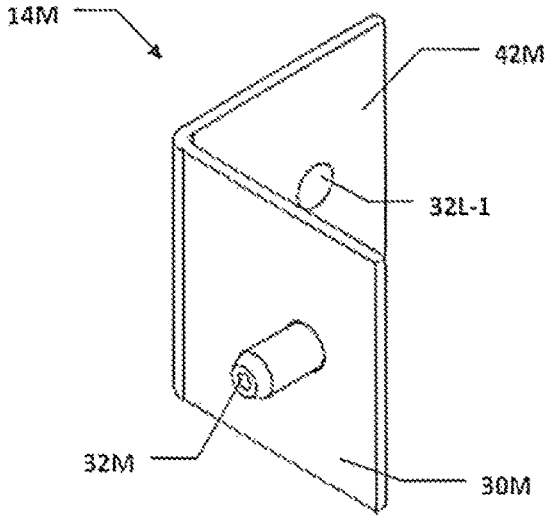
Figure 19:
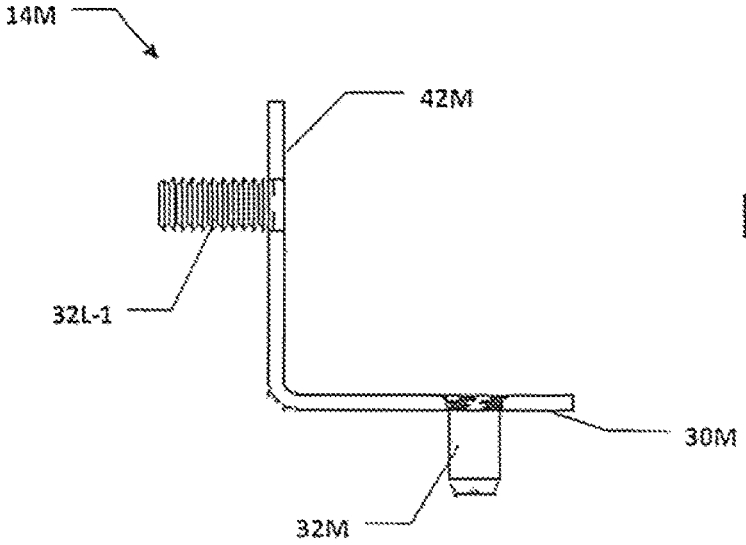
FIG. 19 is a side view of the connecting plate of FIG. 18.

It can also be advantageous to have display tiles 12 connected perpendicularly to one another, for instance, at a joint between a wall and ceiling or at the corner of two walls. Referring to FIGS. 17 and 18, plates 14L and 14M have respective perpendicular post surfaces 42L and 42M. In the depicted embodiment, the posts 32L-1 and 32M-1 on the perpendicular post surfaces 42L and 42M are threaded (with only the underside of 32M-1 visible in FIG. 18; see FIG. 19 for a better view). This permits the additional security of a nut or other threaded fastener when the plates 14L and 14M are holding one or more tiles 12 facing downwards in a horizontal orientation. Preferably, the attraction of the magnets 20 with the plates 14L and 14M is sufficient to overcome the force of gravity in such situations, but the threaded posts 32L-1 and 32M-1 offer the possibility of an even more secure connection for added peace of mind.

During use of the modular display assembly 10, the frame 16 or other support structure is erected. Alternately, an existing support structure could be used. Plates 14H and 141 (and/or plates 14J and 14K) are used to hang a top row of tiles 12. Depending on the desired orientation of tiles 12 to hang therebelow, plates 14A-14G and/or 14L and 14M are connected to bottom corners of the tiles 12 of the top row. Tiles 12 of the second row are then connected to these plates 14 and the process is continued until the desired assembly has been constructed. In the event an individual tile 12 needs to be replaced for any reason, its corners are simply disengaged from the respective plates 14 and the matrix of surrounding tiles 12 and plates 14 is sufficiently strong to maintain its shape in the absence of the tile to be replaced. When the assembly 10 is no longer needed, the tiles 12 and plates 14 are simply disassembled in the opposite order they were assembled. The plates 12 are aligned and stacked easily, held together by respective magnets 20.

The foregoing is provided for illustrative and exemplary purposes; the present invention is not necessarily limited thereto. Rather, those skilled in the art will appreciate that various modifications, as well as adaptations to particular circumstances, are possible within the scope of the invention as herein shown and described and of the claims appended hereto.

What is claimed is:

1. A modular display assembly comprising:

a plurality of display tiles, each of the display tiles having magnets and mounting holes adjacent thereto in locations along a periphery thereof;

a plurality of connecting plates connecting the plurality of display tiles, each of the connecting plates having a base and at least one post; and a support structure supporting the plurality of display tiles and the plurality of connecting plates;

wherein a subset of the plurality of display tiles are suspended vertically and supported only by connection to the support structure through connection to an intervening subset of the plurality of display tiles using a subset of the plurality of connecting plates; and wherein the subset of the plurality of display tiles are only engaged to the subset of the plurality of connecting plates by insertion of respective posts of the subset of the plurality of connecting plates through respective adjacent mounting holes of the subset of the plurality of display tiles, and the respective posts are only retained in the respective adjacent mounting holes by magnetic connection of respective magnets of the subset of the plurality of display tiles at respective locations of the subset of the plurality of connecting plates radially offset from respective axes of the respective posts extending into the respective adjacent mounting holes.

2. The modular display assembly of claim 1, wherein the magnets and mounting holes are located in corners of the plurality of display tiles.

3. The modular display assembly of claim 2, wherein, in the corners of the plurality of display tiles, a relative relationship between locations of the respective magnet and adjacent mounting hole is identical.

4. The modular display assembly of claim 3, wherein, in the corners of the plurality of display tiles, the respective magnet is located closer to an apex of the corner than the respective adjacent mounting hole.

5. The modular display assembly of claim 1, wherein the plurality of tiles are square or a fraction thereof.

6. The modular display assembly of claim 1, wherein a unit design is formed on the plurality of tiles.

7. The modular display assembly of claim 6, wherein the unit design is configured such that different orientations of a given one of the plurality of tiles will align with an adjacent one of the plurality of tiles to create different, but still aligned, overall appearances.

8. The modular display assembly of claim 1, wherein a height of the at least one post of the plurality of connecting plates is greater than a thickness of the plurality of tiles.

9. The modular display assembly of claim 8, wherein the height of the at least one post of the plurality of connecting plates is approximately twice the thickness of the plurality of tiles.

10. The modular display assembly of claim 1, wherein the at least one post of each of the plurality of connecting plates is unthreaded.

11. The modular display assembly of claim 1, wherein the at least one of the plurality of connecting plates includes at least three posts and connects at least three adjacent tiles.

12. The modular display assembly of claim 11, wherein the at least one of the plurality of connecting plates includes at least four posts and connects at least four adjacent tiles.

13. The modular display assembly of claim 1, wherein the at least one of the plurality of connecting plates includes a protruding surface on an opposite side of the base from the at least two posts.

14. The modular display assembly of claim 13, wherein the protruding surface is configured to engage a portion of the support structure.

15. The modular display assembly of claim 14, wherein at least some of the intervening subset of the plurality of display tiles are in a top row of the plurality of display tiles supported by the support structure, the at least one of the plurality of connecting plates including the protruding surface being connected to the at least some of the intervening subset of the plurality of display tiles in the top row.

16. A method of making a modular display assembly, the method comprising:

connecting at least first and second display tiles to a first connecting plate by inserting respective posts on the first connecting plate into respective mounting holes in the first and second display tiles and magnetically connecting the first connecting plate with respective portions of the first and second display tiles adjacent to the respective mounting holes and radially offset from the respective posts;

suspending the first and second display tiles and the first connecting plate from a support structure; and suspending at least a third display tile below the first and second display tiles using a second connecting plate only by inserting respective posts on the second connecting plate into respective mounting holes in the third display tile and at least one of the first and second display tiles, the respective posts on the second connecting plate only being retained in the respective mounting holes in the third display tile by magnetic connection between the third display tile and the second connecting plate at a location adjacent to the respective mounting holes and radially offset from the respective posts such that the third display tile is only indirectly connected to the support structure.

17. The method of claim 16, wherein the first connecting plate is engaged with a portion of the support structure prior to connecting the least two display tiles thereto.

* * * * *